US012302970B2

(12) United States Patent
Falk

(10) Patent No.: US 12,302,970 B2
(45) **Date of Patent: *May 20, 2025**

(54) DECORATIVE TREE WITH INSERTABLE, INTERCHANGEABLE BRANCHES SYSTEM AND METHOD

(71) Applicant: MISF Holdings Inc, Rancho Santa Fe, CA (US)

(72) Inventor: Ira A. Falk, Rancho Santa Fe, CA (US)

(73) Assignee: MISF Holdings Inc, Rancho Santa Fe, CA (US)

( * ) Notice: Subject to any disclaimer, the term of this patent is extended or adjusted under 35 U.S.C. 154(b) by 146 days.

This patent is subject to a terminal disclaimer.

(21) Appl. No.: 18/146,439

(22) Filed: Dec. 26, 2022

(65) Prior Publication Data

US 2023/0137955 A1 May 4, 2023

Related U.S. Application Data

(63) Continuation of application No. 17/063,626, filed on Oct. 5, 2020, now Pat. No. 11,533,960, which is a (Continued)

(51) Int. Cl.
*A41G 1/00* (2006.01)
*A47G 33/06* (2006.01)

(52) U.S. Cl.
CPC ..... *A41G 1/007* (2013.01); *A47G 33/06* (2013.01)

(58) Field of Classification Search
None
See application file for complete search history.

(56) References Cited

U.S. PATENT DOCUMENTS 1,590,220 A 6/1926 Waldemar
1,694,974 A 12/1928 Glover
(Continued)

FOREIGN PATENT DOCUMENTS

JP 01086644 U1 6/1989
JP H08159120 A 6/1996
(Continued)

OTHER PUBLICATIONS

Written Opinion of the International Search Authority dated May 24, 2016; International Application No. PCT/US2016/018544; International Filing Date Feb. 18, 2016.
(Continued)

*Primary Examiner* — Kim S. Horger
(74) *Attorney, Agent, or Firm* — Connie R. Masters

(57) ABSTRACT

A fabricated decorative tree with insertable branches system is provided that includes a tree trunk configured with at least one limb stub that is configured to receive a branch. The trunk, stub, and branch all have internal supports and an external decorative skin. The stub internal support has a proximal end fixedly attached to the trunk internal support and has a stub distal end having a receptor with a channel cut at least through the internal support distal edge. Only the distal end of the branch internal support is covered with the external skin. The uncovered proximal end of the branch internal support is a male sleeve insert having an outwardly projecting alignment protuberance sized to fit within the stub's channel. Means to further secure the stub-branch joint and methods by which one set of interchangeable branches are replaced by a second set of branches are also provided.

15 Claims, 8 Drawing Sheets

Related U.S. Application Data continuation-in-part of application No. 15/681,301, filed on Aug. 18, 2017, now Pat. No. 10,791,781.

(56) References Cited

U.S. PATENT DOCUMENTS

| | | | | |
|---|---|---|---|---|
| 1,737,151 | A | 11/1929 | Derbyshire | |
| 2,826,846 | A | 3/1958 | Warren | |
| 3,101,291 | A | 8/1963 | Lalick | |
| 3,115,435 | A | 12/1963 | Abraham | |
| 3,159,523 | A | 12/1964 | Abraham | |
| 3,164,344 | A | 1/1965 | Whyte | |
| 3,214,318 | A | 10/1965 | Marvin | |
| 3,829,349 | A | 8/1974 | Hermanson | |
| 3,900,637 | A | 8/1975 | Byrd et al. | |
| 4,109,345 | A | 8/1978 | Sargent et al. | |
| 4,291,075 | A | 9/1981 | Puleo | |
| 4,897,292 | A | 1/1990 | Glickman | |
| 5,015,510 | A | 5/1991 | Smith | |
| 5,085,900 | A | 2/1992 | Hamlett | |
| 5,678,297 | A | 10/1997 | Liao | |
| 5,787,649 | A | 8/1998 | Popowych et al. | |
| 6,343,440 | B1 | 2/2002 | Ayers | |
| 6,869,198 | B1 * | 3/2005 | Garza | A41G 1/007 362/122 |
| 10,791,781 | B2 * | 10/2020 | Falk | A47G 33/06 |
| 11,533,960 | B2 * | 12/2022 | Falk | A47G 33/06 |
| 2004/0179353 | A1 | 9/2004 | Yao | |
| 2014/0272205 | A1 | 9/2014 | Altamura | |

FOREIGN PATENT DOCUMENTS

| | | | |
|---|---|---|---|
| JP | 2756762 | B2 | 5/1998 |
| KR | 10-2011-0006928 | | 1/2011 |
| WO | 99/66589 | | 12/1999 |

OTHER PUBLICATIONS

International Search Report of the International Search Authority dated May 24, 2016; International Application No. PCT/US2016/018544; International Filing Date Feb. 18, 2016.

* cited by examiner

Fig. 2
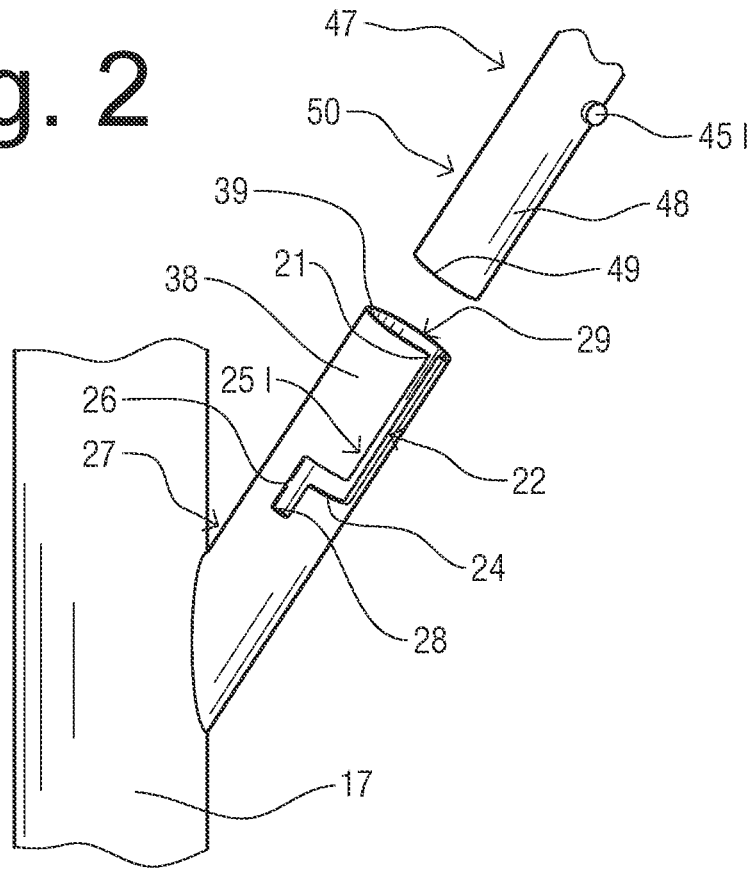
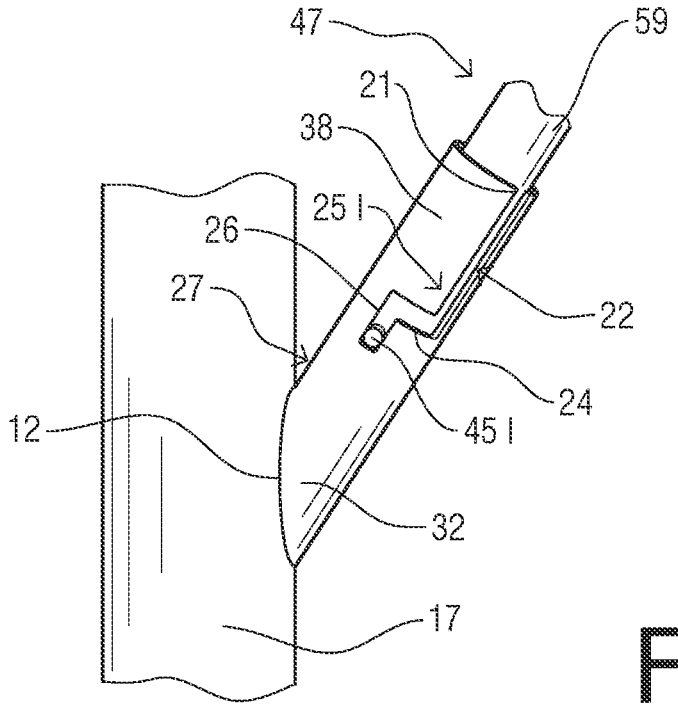
Fig. 3

Fig. 4
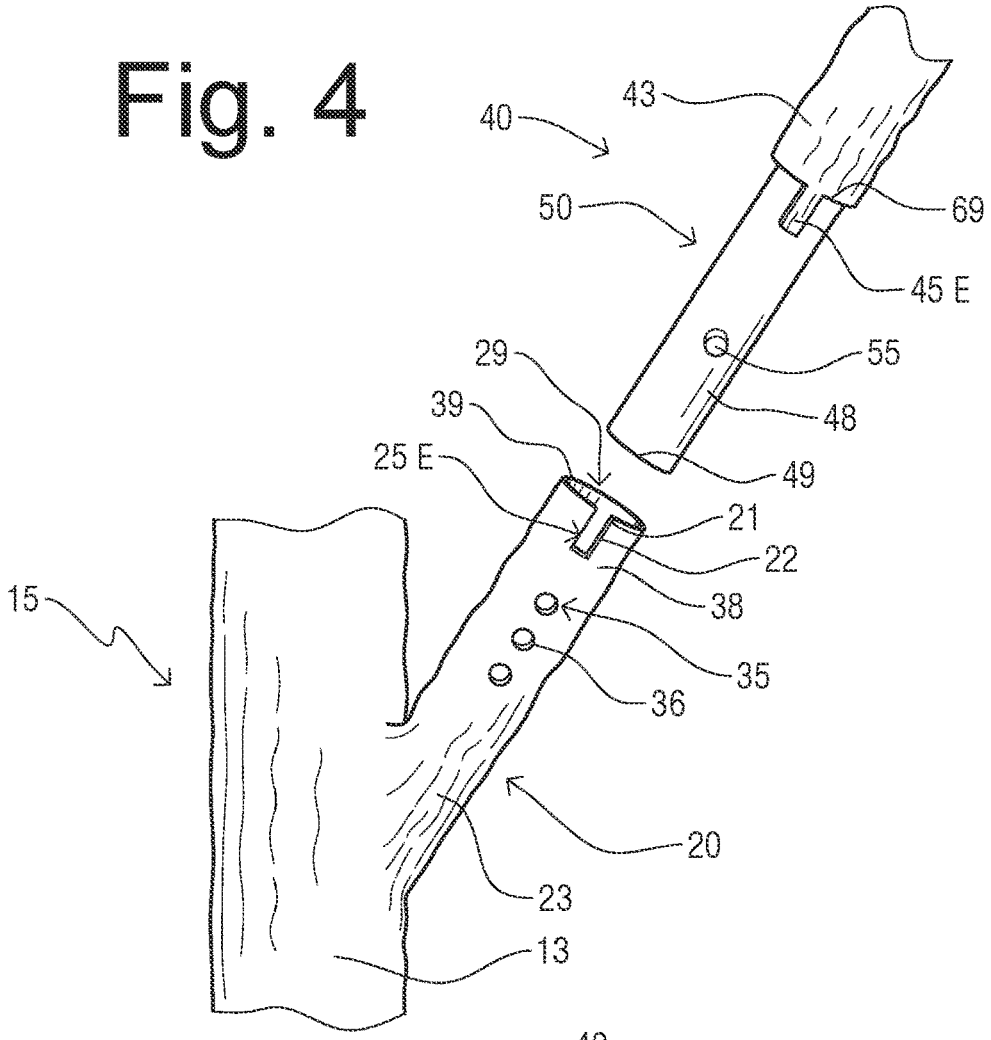
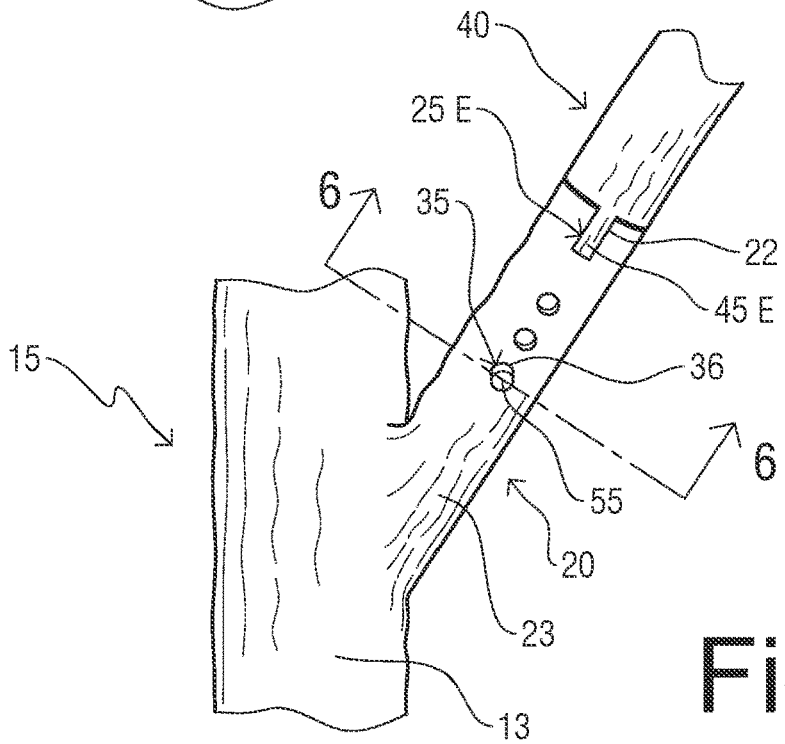
Fig. 5

DECORATIVE TREE WITH INSERTABLE, INTERCHANGEABLE BRANCHES SYSTEM AND METHOD

CROSS-REFERENCE TO RELATED APPLICATIONS

The present application is a continuation of currently U.S. Application (to issue as U.S. Pat. No. 11,533,960 on Dec. 27, 2022), which is a continuation-in-part application of U.S. application Ser. No. 15,681,301 filed on Aug. 18, 2017 (issued as U.S. Pat. No. 10,791,781 on Oct. 6, 2020), which is a bypass continuation-in-part application of international application No. PCT/US2016/018544 having an international filing date of Feb. 18, 2016 and designating the United States, the international application claiming a priority date of Feb. 18, 2015 based upon prior-filed U.S. provisional patent application No. 62/117,866 filed on Feb. 18, 2015, the entire contents of the aforesaid applications being incorporated herein by reference.

FIELD OF INVENTION

This invention relates to a decorative tree having a tree trunk including at least one limb stub for receiving an insertable, removable, interchangeable branch.

BACKGROUND OF THE INVENTION

A variety of decorative trees are commercially available, particularly due to the interest in artificial Christmas trees. Though many are collapsible for storage, a few have branches that are connectable to the tree trunk, but the variety of branch-to-trunk connections tend to be not particularly sturdy. It is postulated that this may be because usually a Christmas tree has relatively light branches; is used in an indoor, wind-free, residential environment; and is used for a limited length of time each year.

However, there are other uses for decorative trees, such as for displays or to enhance a commercial setting. In situations where there is a need for a decorative tree that is larger, that is designed for commercial applications, and/or that is suited to a demanding environment, it would be advantageous to provide a trunk and insertable/removable branch system that has a robust connection between the insertable/removable branches and the trunk. In all situations, insertable branches that are easy to install, remove, and replace would be useful. For example, if a branch suffers damage, it could be replaced. Particularly useful would be a system and method in which multiple sets of visually distinguishable branches are supplied and in which one set of branches can be quickly and easily removed to be replaced by a second set of branches to markedly change the appearance of the fabricated tree.

U.S. Pat. No. 5,787,649 to Popowych et al. and U.S. Pat. No. 6,343,440 to Ayers both provide a monopole tower with receptors supporting artificial palm fronds or pine boughs that are permanently installed utilizing bolts and cables attached to a clamp. Though the connections may be robust, the palm fronds or pine boughs are not meant to be removed and replaced. Consequently, this one-time installation is time consuming and is not suitable for situations in which the removal and replacement of the artificial branches is recurrent on a periodic basis.

U.S. Pat. No. 3,829,349 to Hermanson provides an artificial Christmas tree that allows branches to be installed in layers, as the trunk of the tree is built upward. This design is also not suitable for the recurring substitution of one set of branches for another, because the trunk must be disassembled to install the layers of branches.

Accordingly, there is a need for a decorative tree with insertable, removable, interchangeable branches that allows one set of branches to be quickly, easily installed and then uninstalled to allow a second set of branches to be installed, but that also provides a sturdy connection between the branch and its corresponding limb stub.

BRIEF SUMMARY OF THE INVENTION

The present invention is directed to a decorative tree system having insertable, removable, interchangeable branches and is further directed to a method of use that allows a first set of these interchangeable branches to be removed and replaced by a second set of interchangeable branches.

The decorative tree system includes a tree trunk having at least one limb stub configured for receiving an insertable, removable, interchangeable branch (usually multiple limb stubs each receive a branch). The tree trunk includes a trunk internal support and a trunk external decorative skin fixedly attached to at least a portion of the exterior of the trunk internal support.

The limb stub is attached to the tree trunk, and the internal portion of its distal end forms the receptor for the branch to be inserted. The limb stub has a stub internal support and a stub external decorative skin.

The stub external decorative skin is fixedly attached to the exterior of at least a portion of the stub internal support and is also directly adjacent to, attached to, or formed integrally with the trunk external decorative skin. For instance, if the external decorative skin of both the stub and tree trunk are bark-like, the trunk-stub connection may imitate a tree's natural appearance with the bark of the branch continuing (or appearing to continue) from the bark of the tree trunk.

The proximal end of the stub internal support is fixedly attached to (or formed integrally with) the trunk internal support at a pre-determined angle, as desired for the particular limb stub given the particular size, shape, and location of the branch to be attached. Disposed at the distal end of the receiving stub is a female receiving portion or receptor that receives the male sleeve insert of the insertable branch. In the first embodiment, the receptor is configured with channel edges defining a guide channel. In the various aspects of the first embodiment the guide channel may be angled, notched, curved or straight and may be short or long. In the embodiments, the channel may be an interior channel (interior of the skin) or an exterior channel. The channel is used to promote alignment and/or positioning and/or securing.

The insertable branch has a branch internal support and a branch external decorative skin. The branch skin is fixedly attached to a distal portion of the branch internal support, but a proximal portion of the branch internal support, the male sleeve insert, is not covered by the branch external decorative skin.

In the embodiments, the stub-to-branch connection allows the convenient attachment of the insertable branch at the pre-determined angle of the limb stub. Multiple examples of stub-to-branch connections are provided. In most aspects, when the branch is connected to the stub, the proximal portion of the branch external decorative skin is adjacent to the distal portion of the stub skin. Therefore, the designs of both the branch skin and stub skin are preferably complementary for concealment of the seam. For instance, if both skins are bark-like, the stub-to-branch connection imitates a tree's natural appearance or if both skins are embossed metal, then the seam at the stub-to-branch connection may be integrated into the embossing design for camouflage.

In the first embodiment, the un-skinned portion of the branch sleeve is configured with an alignment protuberance, which is sized to fit within an interior (under the skin) guide channel of the limb stub internal support, but it but remains under the outer skin. Besides the alignment function of the alignment protuberance, the protuberance also serves to lock or secure the branch to the limb stub. In this embodiment, the channel is angled and/or curved. To connect the branch to the limb stub, an interior (interior of the skin) outwardly projecting alignment protuberance is engaged within the top entrance of the guide channel and is lowered into the channel following any jogs, curves, or angles of the channel to the final resting place of the alignment protuberance at the bottom stop of the channel. This provides resistance to inadvertent removal of the branch, such as by high winds or accidental bumping.

In the second embodiment, two optional securing systems are disclosed. In one aspect, the limb stub internal support is configured with one or more lock holes. The un-skinned portion of the branch sleeve is configured with an outwardly protruding engaging member, which has a locking pin sized and configured to fit within one of the lock holes. In another aspect, the limb stub is configured with an external channel, and the branch is configured with a branch sleeve exterior alignment protuberance. The branch sleeve exterior alignment protuberance is sized and configured to fit within the exterior channel of the stub, which serves to align the branch to the stub. If both aspects are used together in the second embodiment, the alignment protuberance additionally serves to facilitate alignment of the locking pin with the locking aperture. In this case, to connect the branch to the limb stub, the alignment protuberance is aligned with and then inserted into the top entrance of the exterior channel, locating the locking pin in a position to be received within one of the locking apertures as the proximal end of the branch is further inserted into the distal end of the stub.

In the third embodiment, one or both of the stub internal support (in addition to being configured with a guide channel) and/or the branch male sleeve insert (in addition to being configured with an alignment protuberance) are configured with one or more permanent magnets. When the male sleeve insert is received within the receptor of the stub internal support, any magnet(s) included are magnetically attracted to the corresponding magnet(s) or to ferromagnetic materials in the opposing member, thereby forming a magnetic stub-to-branch connection. As in the other embodiments, an internal or external alignment protuberance is engaged within the guide channel.

In use, the decorative tree may be provided to an establishment or residence with one set of branches or with multiple interchangeable sets of branches. For example, seasonal sets may be supplied, such as bare branches for winter, budded branches for spring, green-leaved branches for summer, and branches with autumn-colored leaves for fall. In another example, an event hall may have multiple set of branches, each set of which is designed to coordinate with a particular theme, such as cherry blossom branches for a Japanese theme, branches with leaves of yellow and purple and green for a Mardi Gras theme, branches with gold and silver metallic diamond-shaped "leaves" for a modern theme, etc.

The stub-to-branch connection provides sturdy support for the branches yet allows quick and easy removal of the branches of a first set and replacement with a second interchangeable set of branches. Therefore, a single fabricated tree can express multiple, decidedly different looks, which can be advantageous in both commercial and residential installations. The ease of replacement reduces labor costs for commercial installations, which is particularly advantageous to businesses with multiple units of the decorative tree.

An object of the present invention is to provide a decorative tree with insertable branches that allows quick removal and replacement of the branch elements.

A further object of the present invention is to provide a decorative tree with insertable branches that provides good support for the branches.

These and other objects, features, and advantages of the present invention will become more readily apparent from the attached drawings and from the detailed description of the preferred embodiments which follow.

BRIEF DESCRIPTION OF THE SEVERAL VIEWS OF THE DRAWINGS

The preferred embodiments of the invention will hereinafter be described in conjunction with the appended drawings, provided to illustrate and not to limit the invention, where like designations denote like elements.

FIG. 2 is a partial enlarged front perspective view with the external decorative skin of both the stub and branch removed, showing the stub internal support and the branch internal support, which are unengaged.

FIG. 3 is the view of FIG. 2 with the internal alignment protuberance of the branch internal support engaged within the internal channel of the stub internal support.

FIG. 4 is a partial enlarged front perspective view of a portion of the exterior of the stub and branch of the second embodiment, which are unengaged.

FIG. 5 is the view of FIG. 4 with an external alignment protuberance of the branch engaged in the external channel of the stub and with the branch locking pin disposed within a locking aperture of the stub.

Like reference numerals refer to like parts throughout the several views of the drawings.

DETAILED DESCRIPTION OF THE INVENTION

Figure 1:
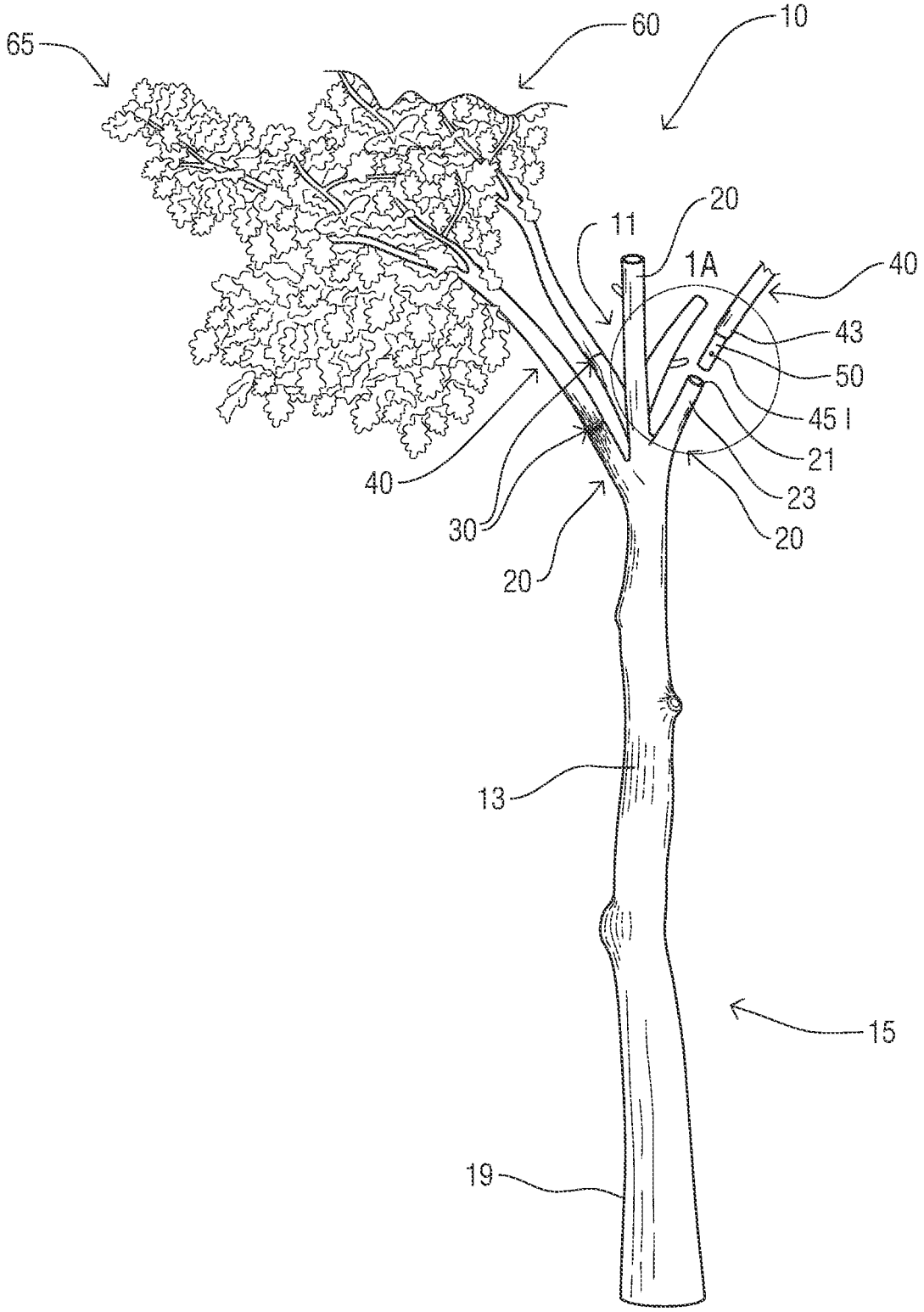
FIG. 1 is a front perspective view of the first embodiment of the present invention.

Shown throughout the figures, the present invention is directed toward a system of decorative, fabricated, insertable, removable, interchangeable branches for use with a decorative fabricated tree, shown generally as reference number 10, and a method of using the interchangeable branches, which advantageously allows the replacement of one type or style of branch (or set of branches) with a different type or style of branch (or set of branches). The modular branches are supported in a sturdy stub-to-branch connection (at stub-branch joint 30), yet each branch is quickly and easily removable for replacement with a different type or style of branch.

In all of the multiple embodiments, the decorative tree with insertable branches system 10 comprises a tree trunk 15 including at least one limb stub 20 that is configured to receive an insertable, interchangeable branch 40, and usually will include multiple stubs 20 each of which accommodates a branch 40. The branch 40 may include a branch-leaf component 65 or may not (such as when imitating a deciduous branch in winter). When the branch 40 is inserted into the limb stub 20 the stub-branch joint 30 is preferably barely visible, being obscured by the irregularity or pattern of the exterior decorative skins 23, 43 of the stub 20 and branch 40.

The trunk 15, limb stub 20, and branch 40 all have internal supports 17, 27, 47 and an external decorative skin 13, 23, 43, respectively. For clarity in discussing the internal structures (such as the internal supports 17, 27, 47 and the reversible coupling system of the stub-to-branch connection), FIGS. 2-3 show a portion of the trunk 15, limb stub 20, and branch 40 without the corresponding external decorative skin 13, 23, 43.

The stub internal support 27 has a proximal end 32 (FIG. 3) fixedly attached to the trunk internal support 17 at a trunk-stub connection 12. The trunk-stub connection 12 may be formed by any method suitable for the size and materials of the tree. For example, if stub internal support 27 and trunk internal support 17 are large and metal, the trunk-stub connection 12 may be a welded joint, but if the internal supports 17, 27 are small and plastic, they may be formed integrally (such as by injection molding or other molding methods) or they may be adhesively attached.

The interior portion of the stub distal end 38 (FIGS. 2, 4) is the stub internal support 27, which is configured as a receptor 29.

The branch internal support 47 is only partially covered with the decorative skin 43. At least a portion of the branch internal support distal portion 59 is covered with the decorative skin 43, but at least a portion of the proximal portion 48 (FIGS. 1A, 2) of the branch internal support 47 is left uncovered by the decorative skin 43 to form the bare or non-skinned male sleeve insert 50. The male sleeve insert 50 is sized and designed to allow manual installation into the receptor 29 of the stub internal support 27. To allow the male sleeve insert 50 to slide into the interior of the receptor 29, the male sleeve insert 50 does not have a rough bark-like exterior but has a generally smooth exterior surface. This outer stub and inner branch engagement necessitates that the exterior diameter of the male sleeve insert 50 (which is preferably a cylindrical tube or the like with a smooth exterior) is smaller than the inside diameter of the stub internal support 27 (which is preferably also a cylindrical tube or the like with a smooth interior).

In all of the embodiments, a reversible coupling system is employed both to enhance the strength of the stub-branch joint 30 when the male sleeve insert 50 is inserted into the stub receptor 29 and to allow the male sleeve insert 50 to be removed when necessary for removal and replacement of the branch 40. The reversible coupling system of the first embodiment of FIGS. 1-3 utilizes an internal alignment protuberance 45I engaged within an angled, curved, or otherwise non-straight internal channel 25I. The reversible coupling system of the second embodiment of FIGS. 4-6 utilizes at least an external alignment protuberance 45E which engages with an external through-type guide channel 25E. In an aspect the second embodiment of FIGS. 4-6 uses a locking pin 44 and a corresponding locking aperture 35. The reversible coupling system of the third embodiment of FIG. 7 provides an internal alignment protuberance 45 and corresponding channel 25, and, in an aspect, provides one or more magnets. In all three embodiments, the guide channel 25 along with the alignment protuberance 45 are used to facilitate proper alignment for coupling of the male sleeve insert 50 of the interchangeable branch 40 with the receptor 29 of the stub 20.

In the embodiments, the alignment protuberance 45 is a stem, tab, button, prong, tongue, or other projection that extends outwardly from or over the male sleeve insert 50. The alignment protuberance 45 may be formed integrally with the male sleeve insert 50 or may be permanently attached to the exterior of the male sleeve insert 50, such as by welding or permanent adhesive. If formed separately and attached, the alignment protuberance 45 may or may not be formed of the same material as the male sleeve insert 50. The alignment protuberance 45 may be internal and bare or unskinned, as shown in the first embodiment (FIGS. 1A, 2-3) and third embodiments (FIG. 7), or may be external and skinned, as shown in the second embodiment of FIGS. 4-6.

In the embodiments, the stub internal support 27 has a distal end (disposed at stub distal end 38, as seen in FIGS. 2, 3, 4) configured with a channel 25 (internal or external) that receives the branch's internal alignment protuberance 45I (in the first embodiment) or the exterior alignment protuberance 45E (in the second embodiment). The channel 25 is an opening or notch at the edge 39 of the receptor 29. The channel 25 may be straight or non-straight (angled and/or curved). For example, edges 22 (FIG. 2) may define a straight channel 25 defined by opposing top entrance edges 21, opposing vertical channel portion edges 22, and a bottom stop edge 28.

In all the embodiments, a single tree system 10 is provided with at least one set 60 of branches 40 with each branch 40 of the set 60 insertable into the receiving stub 20 by use of the reversible coupling system. Preferably, multiple interchangeable sets 60 of branches are supplied with the tree system 10 or additional sets 60 are available for ordering, as desired. Although an additional set 60 of branches may include branches 40 that are identical to the branches 40 of the first set (such as for replacement of worn branches), it is advantageous if multiple sets 60 of visually distinguishable branches are available. This enables the removal of the first set 60 and the replacement with a second set having a markedly different appearance (such as a variation in color, shape, texture, and/or material). Advantageously, with a single installed tree trunk with attached limb stubs, multiple set 60 of stylistically different branches 40 can be rotated in and out. This allows the user of the system 10, with a minimal of effort, to give a fresh, new look or different atmosphere to the area in which the tree system 10 is installed. Additionally, if the user of the tree kiosk system 10 remodels and, for example, lowers the height of the ceiling, a set 60 of generally vertical branches can be replaced with a set 60 of more horizontally spreading branches having a lower vertical height.

In the first embodiment of FIGS. 1-3, the internal channel 25I serves as an internal guideway for the branch's outwardly-projecting internal alignment protuberance 45I. The channel 25I is non-straight (angled, jogged, notched, and/or curved) to improve engagement and to secure the connection. To maintain an outer natural appearance, the channel 25I is interior of the external decorative skin 23, as can be seen best in FIG. 1A. Consequently, no opening is created in the external decorative skin 23. An exemplary angled channel is shown, which is defined by opposing top entrance edges 21, two sets of opposing vertical channel portion edges 26, opposing horizontal channel portion edges 24, and a bottom stop edge 28.

In the first embodiment, the alignment protuberance 45 is positioned at a pre-determined interconnection distance B (FIG. 1A) from the proximal edge 49 of the sleeve insert 50. The interconnection distance B from alignment protuberance 45 to the proximal edge 49 of the sleeve insert 50 is the distance that, when the modular branch 40 is attached, the sleeve insert 50 will extend beyond the bottom stop edge 28 of the channel 25I. This extension of the lower portion of the sleeve insert 50 beyond the bottom stop edge 28 enhances the strength of the stub-branch joint 30. An exemplary length of the interconnection distance B may be in the range of from one-half to six diameters of the sleeve insert 50.

The non-skinned male sleeve insert 50 extends a pre-determined overlap distance A (FIG. 1A) from alignment protuberance 45 to the bottom edge 69 of the decorative skin 43. When sleeve insert 50 is inserted within the receptor 29, the bare (un-skinned) branch internal support proximal portion 48 overlaps the upper part of the receptor 29 the pre-determined overlap distance A. The overlap distance A is the distance above the alignment protuberance 45 to the decorative skin edge 69. An exemplary length of the overlap distance A may be in the range of from one to six diameters of the sleeve insert 50.

Though the figures show the overlap distance A as approximately equal to the interconnection distance B, there is no requirement for this. For instance, the alignment protuberance 45 can be disposed quite near the proximal edge 49 of sleeve insert 50 (thus the interconnection distance would be quite small), and the distance between the alignment protuberance 45 and the edge 69 of the decorative skin 43 could be much longer than illustrated (thus the overlap distance A would be quite large in comparison to the interconnection distance B). A short distance B may provide advantages to allow the limb stub 20 to be short, which may facilitate shipping. A longer interconnection distance B would force the limb stub 20 to be longer, which might be useful to move the stub-branch joint 30 to a more obscure location. A longer overlap distance A may strengthen the stub-to-branch connection when the branches have a wider diameter or the tree system 10 is to be used in a high wind area. A determination of the interconnection distance and the overlap distance may be made for each branch independently of other branches or simultaneously for multiple branches of a set. The determination of the interconnection B and overlap A distances may be based on considerations of manufacturing ease, aesthetic interests, functional requirements, shipping needs, environment of use considerations, the diameter and weight of the branch, and the like.

FIG. 2 (illustrating the internal components without the external decorative skin 13, 23, 43 for clarity of discussion) shows the male sleeve insert 50 properly aligned to be manually engaged with receptor 29 of the stub internal support 27. The alignment protuberance 45 is in alignment with the channel 25I opening between the opposing top entrance edges 21, so is properly aligned for lowering sleeve insert 50 downward toward the stub receptor 29.

FIG. 3 illustrates the assembled stage (again with the decorative skins 23, 43 removed). The alignment protuberance 45 has been manually inserted into the channel entrance at opposing top entrance edges 21, has been slid vertically downward along the first vertical channel portion defined by first opposing vertical edges 26A, has been slid horizontally along the horizontal channel portion defined by opposing horizontal edges 24, has been slid vertically down the second vertical channel portion defined by opposing vertical edges 26B, and has come to rest at the bottom stop defined by bottom stop edge 28. In the exemplary illustration of FIGS. 2-3, the length of the interconnection distance B (from the alignment protuberance 45 to the edge 49) is slightly greater than the length of the internal support 27. Therefore, in this particular example, the sleeve insert 50 will extend somewhat past the trunk-stub connection 12 and into the trunk internal support 17.

Figure 1A:
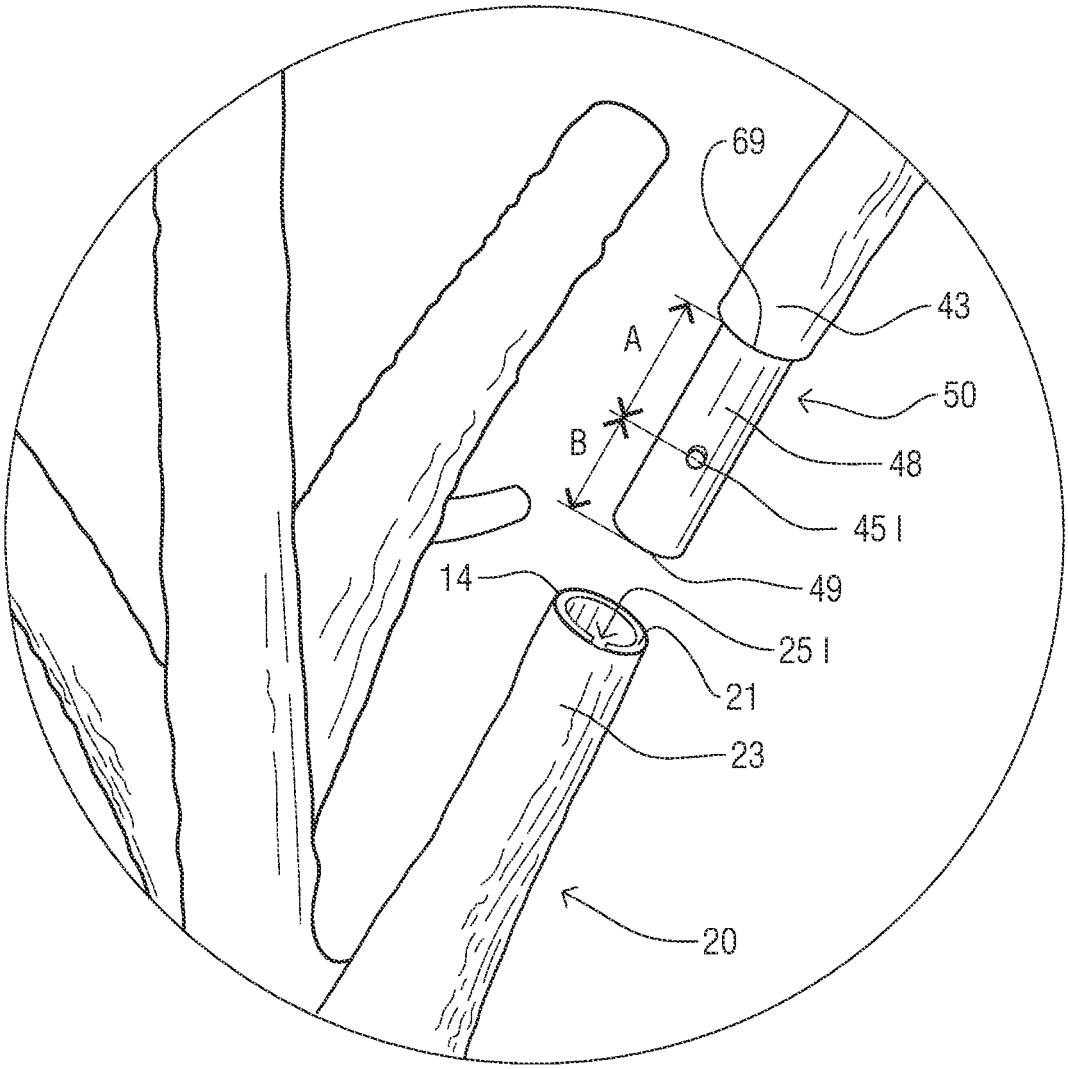
FIG. 1A is a detail view taken from circle 1A of FIG. 1.

When in the assembled stage, the sleeve insert 50 of the branch 40 is fully inserted into the limb stub internal support 27 until the alignment protuberance 45 rests in the channel bottom stop defined by bottom stop edges 28. In this position, the bottom portion 69 of the external decorative skin 43 of branch 40 is adjacent to the top portion 14 of the external decorative skin 23 of the stub 20, forming the stub-branch joint 30 (FIGS. 1, 1A). The irregularities and/or design of the external decorative skin 23, 43 cause the stub-branch joint 30 to be barely perceptible.

Figure 6:
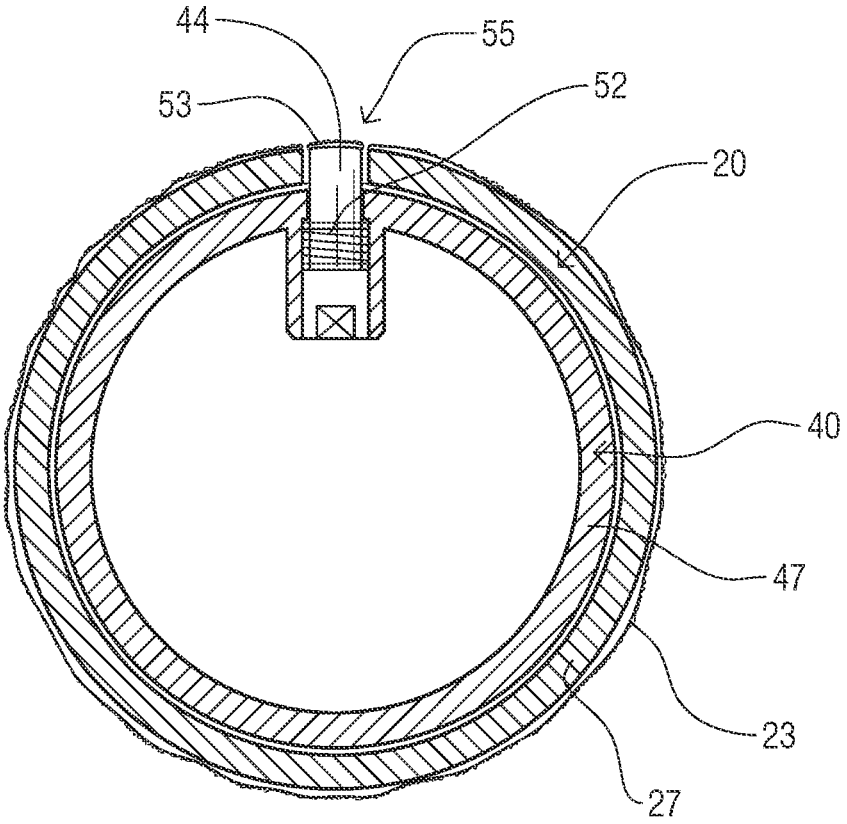
FIG. 6 is a cross-sectional view taken along line 6-6 of FIG. 5 showing the branch male sleeve insert portion of the branch internal support disposed inside the stub internal support, and the branch locking pin received by the locking aperture of the stub.
Figure 7:
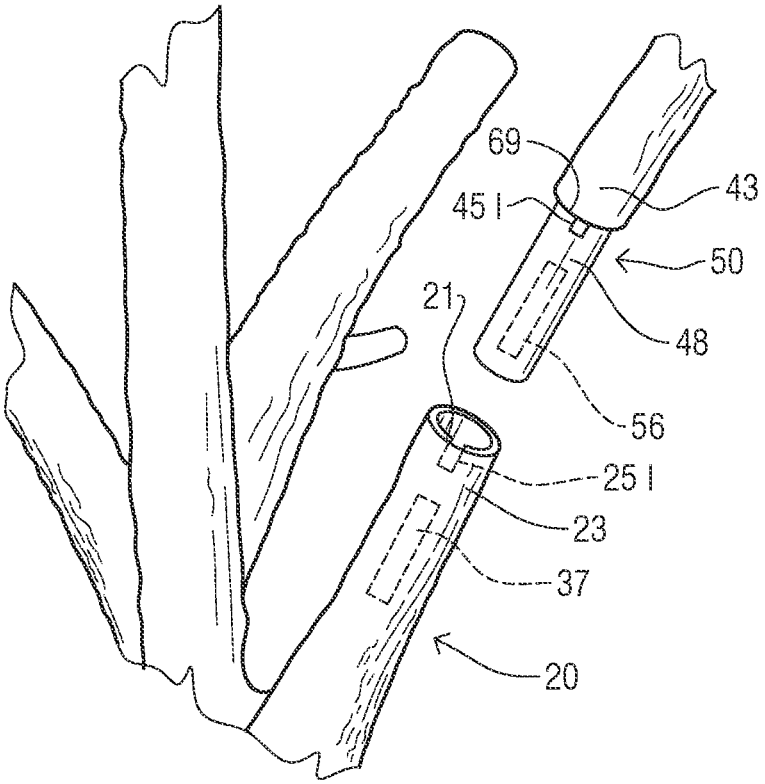
FIG. 7 is a partial enlarged front perspective view of a portion of the exterior of the stub and branch of the third embodiment, which are unengaged.

The second embodiment of FIGS. 4-6 shares many features with the first embodiment, but it provides a second reversible coupling system used to create the stub-to-branch connection. The second reversible coupling system varies from the first embodiment in the type of the outward projection (alignment protuberance 45E), the type of channel (exterior channel 25E), and in the addition of an engaging member 55 and a complementary locking aperture 35. The second embodiment provides two basic aspects that may be used independently or together. The first aspect provides an external alignment protuberance 45E to be received by channel 25E. The second aspect provides an engaging member system 55 (such as a spring-biased push button assembly having a locking pin 44) to be received by a locking aperture 35.

As in the first embodiment, a projection (external alignment protuberance 45E) is received by the channel, which in this embodiment is an external guide channel 25E. In the second embodiment, in contrast to the first embodiment, the channel 25E is straight, and it extends through both the stub internal support 27 and the stub external decorative skin 23. The alignment protuberance 45E is disposed adjacent to the proximal edge 69 of the branch external decorative skin 43, and the branch external decorative skin 43 extends from this proximal edge 69 onto the outer surface of the alignment protuberance 45E. Preferably the branch external decorative skin 43 external to the distal portion of the branch 40 is formed integrally with the branch external decorative skin 43 external to the skinned external alignment protuberance 45E.

The external channel 25E has a channel width and a channel length. The external alignment protuberance 45E is received into, and substantially fills, the external channel 25E. The alignment protuberance 45E is sized and shaped to correspond to the size and shape of the channel 25E. Thus, the alignment protuberance 45E has a length close to, but slightly less than, the channel length and has a width close to, but slightly less than, the channel width. The alignment protuberance 45E can be slidingly engaged into the channel 25E, thus must necessarily be slightly less in width and length than the channel to fit into the channel 25E. When the alignment protuberance 45E is inserted into the channel 25E, the branch external decorative skin 43 of the alignment protuberance 45E is adjacent to the stub external decorative skin 23 at the edges of the channel 25E, which serves to obscure the edges of the connecting portions.

Optionally, the alignment protuberance 45E may be formed integrally with the branch 40 or may be formed separately and fixedly attached to the branch 40.

In the second aspect of the second embodiment, the locking aperture 35, defined by aperture edge 36, extends through the stub internal support 27 and the stub external decorative skin 23. There may be a single locking aperture 35, or, in a variation, multiple aligned locking apertures 35 are provided to allow branches with different overlap distances A (FIG. 1A) to be used with the tree system 10 and/or to allow adjustment of the length of the branch 40. Generally, the one or more apertures 35 will be disposed on the distal portion of the stub 20, though they may additionally or instead by disposed on the proximal portion of the stub 20.

An engaging member system 55 is at least partially secured within the sleeve insert 50 of the branch internal support 47. The engaging member system 55 preferably includes a spring-biased push button assembly having a locking pin 44 that, when the branch is connected to the stub, projects through the stub aperture 35 to hold the branch 40 in place with respect to the stub 20. In a preferred aspect, the locking pin 44 extends outwardly radially with a skinned top surface. The top surface is configured with a portion of skin, pin external decorative skin 53, that visually corresponds to the outer surface of the stub external decorative skin 23, thus obscuring the locking pin 44 and providing a more uniform look. The top surface of the locking pin 44 preferably substantially fills the stub aperture 35.

To attach the branch 40 to the stub 20, the locking pin 44 of the engaging member system 55 is aligned with the aperture 35 and the locking pin 44 is urged radially outward by a spring 52 to lock the branch 40 and stub 20 against relative movement. When the branch 40 is to be removed, the locking pin 44 of the engaging member system 55 is depressed (through the aperture 35) against the spring force, and the branch 40 can be removed. Or, optionally, the locking pin 44 of the engaging member system 55 can be moved to a different one of the aligned apertures 35 (if provided). The engaging member system 55 may include only a single spring-biased locking pin 44, as illustrated in FIG. 6, or may include two locking pins 44, such as on opposing sides of the sleeve insert 50 (in which case two opposing sets of apertures 35 will be included on opposing sides of the stub 20). In one preferred aspect, the one or more apertures 35 are disposed on the top of the branch 40, which serves to obscure the connection from the view of people walking below the tree, yet the connection is easily viewable by, and accessible to, a maintenance person on a ladder.

In the second embodiment, to attach the branch 40, the branch 40 is brought near the stub 20. The proximal portion of the male sleeve insert 50 enters the distal end 38 of the stub 20. The locking pin 44 is depressed, and the sleeve insert 50 is moved further into the distal end 38 of the stub 20 with the locking pin 44 in the depressed state. The branch 40 is turned to align the alignment protuberance 45E with the channel 25E, which rotates the locking pin 44 of the engaging member system 55. At this point, the locking pin 44 is above the aperture 35 with which it will be engaged, but it is in line with it. As the branch 40 is brought lower, the alignment protuberance 45E slides into the channel 25E, which also causes the location of the locking pin 44 of the engaging member system 55 to correspond to the location of the aperture 35. When locking pin 44 aligns with the location of the aperture 35, the locking pin 44 is pushed lower into the stub 20, the locking pin 44 is urged radially outward by the spring 52 to lock the branch 40 and stub 20 against relative movement. Due to the force exerted by the spring 52, the locking pin 44 maintains an outwardly extending thrust into the aperture 35 until the steps are reversed to remove the branch 40.

The third embodiment of FIG. 7 illustrates another variation in the reversible coupling system. The third embodiment is similar to the second embodiment in that the location of the alignment protuberance 45 is adjacent to the proximal edge 69 of the branch external decorative skin 43, but it is different than the second embodiment in that the alignment protuberance 45 of the third embodiment is un-skinned or bare. The branch external decorative skin 43 does not extend from the edge 69 onto the surface of the alignment protuberance 45. The third embodiment is similar to the first embodiment in that the channel 25I is not cut through the stub external decorative skin but is only cut through the internal support 27.

In an aspect of the third embodiment, in contrast to the other embodiments, one or both of the stub internal support 27 and the branch internal support 47 are configured with permanent magnets 37, 56, respectively. If the stub internal support 27 and/or the branch internal support 47 are formed of ferrous materials, only one magnet will be required. The branch magnet 56 may be located within the annular interior of the tubular male sleeve insert 50 or may be disposed within the wall of the male sleeve insert 50. The stub magnet 37 may be disposed within the wall of the stub internal support 27, within the stub external decorative skin 23, between the stub internal support 27 and the stub external decorative skin 23, or partially within both the stub internal support 27 and the stub external decorative skin 23.

To use the third embodiment, in the aspect in which no magnets are included, the branch 40 is brought near the stub 20 with the alignment protuberance 45 aligned with the channel 25I and lowered into the receptor 29. The alignment protuberance 45 is fully inserted into the channel 25I and rests below the external decorative stub skin 23. The branch 40 is supported by the stub 20 by the engagement of the alignment protuberance 45 with the channel 25I. In this aspect, the channel 25I and the protuberance 45 may be longer than shown in FIG. 7.

To use the third embodiment, if only one magnet is included (stub magnet 37 or branch magnet 56), the opposing internal structure (stub internal support 27 or branch internal support 47) will necessarily include ferromagnetic materials, such as iron, steel, cobalt, nickel, or the like. The branch 40 is brought near the stub 20 with the alignment protuberance 45 aligned with the channel 25 and lowered into the receptor 29. The alignment protuberance 45 is fully inserted into the channel 25. The magnetic attraction created between the magnet 37 or 56 and the opposing internal structure 27 or 47 enhances the strength of the stub-branch joint 30.

To use the third embodiment, if both magnets 37, 56 are included, the branch 40 is brought near the stub 20 with the alignment protuberance 45I aligned with channel 25I, and the branch end is lowered into the receptor 29 to allow the magnets to engage and the protuberance 45 to be received by the channel 25I. In an aspect, the branch 40 is brought near the stub 20, with the alignment protuberance 45 to one side or the other of the channel 25, and lowered into the receptor 29, but it then turned to align the alignment protuberance 45 with the channel 25, which allows the branch 40 to drop lower. This aspect may provide an easier installation, as the magnets do not attract until the branch is in the lower position. The magnets fully engage when the branch magnet 56 corresponds in location to the complementary stub magnet 37. The magnetic field created between the two magnets 37, 56 enhances the strength of the stub-branch joint 30.

Figure 8:
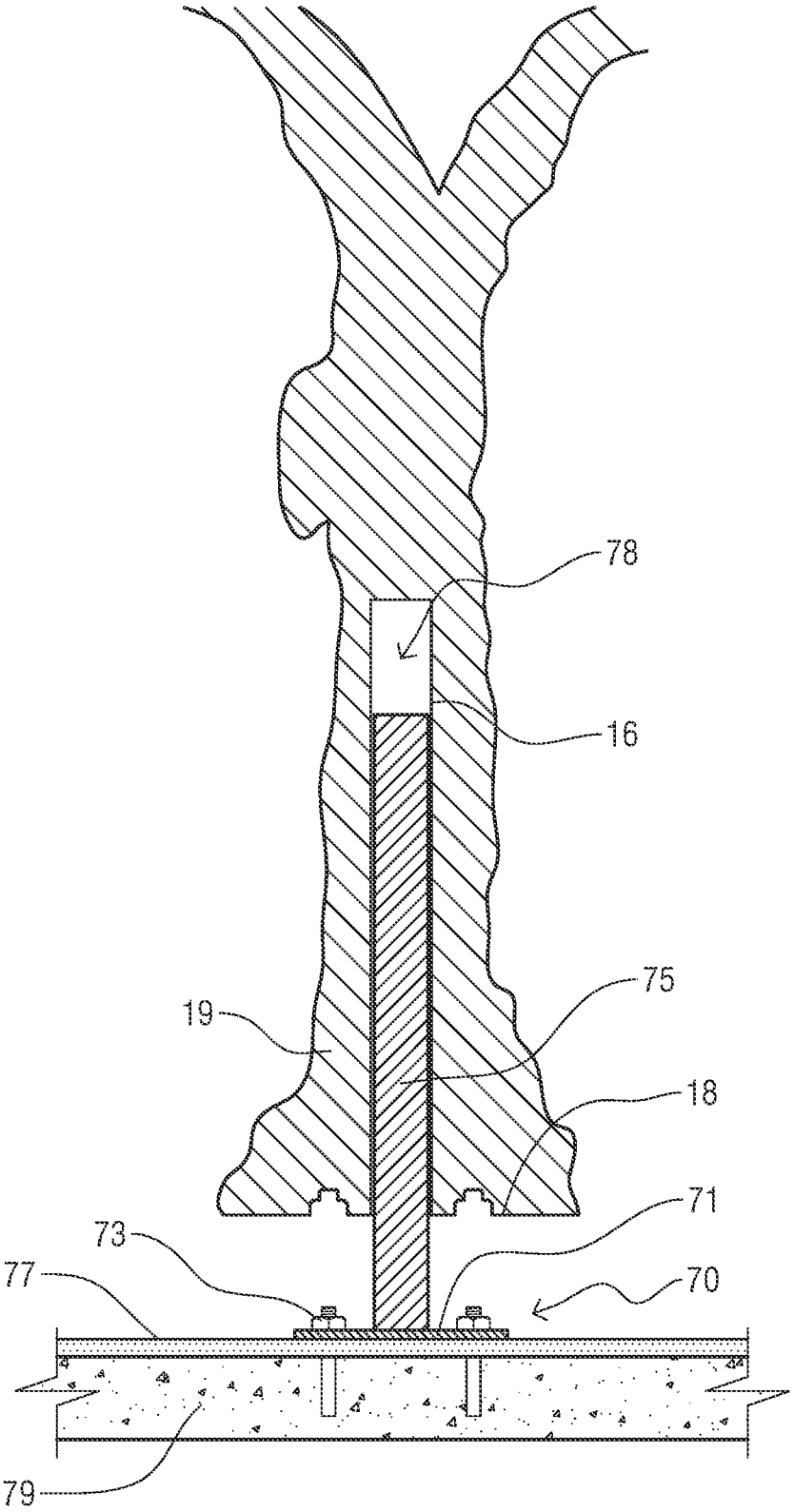
FIG. 8 is a cut diagram showing a first support base of an embodiment of the current invention.
Figure 9:
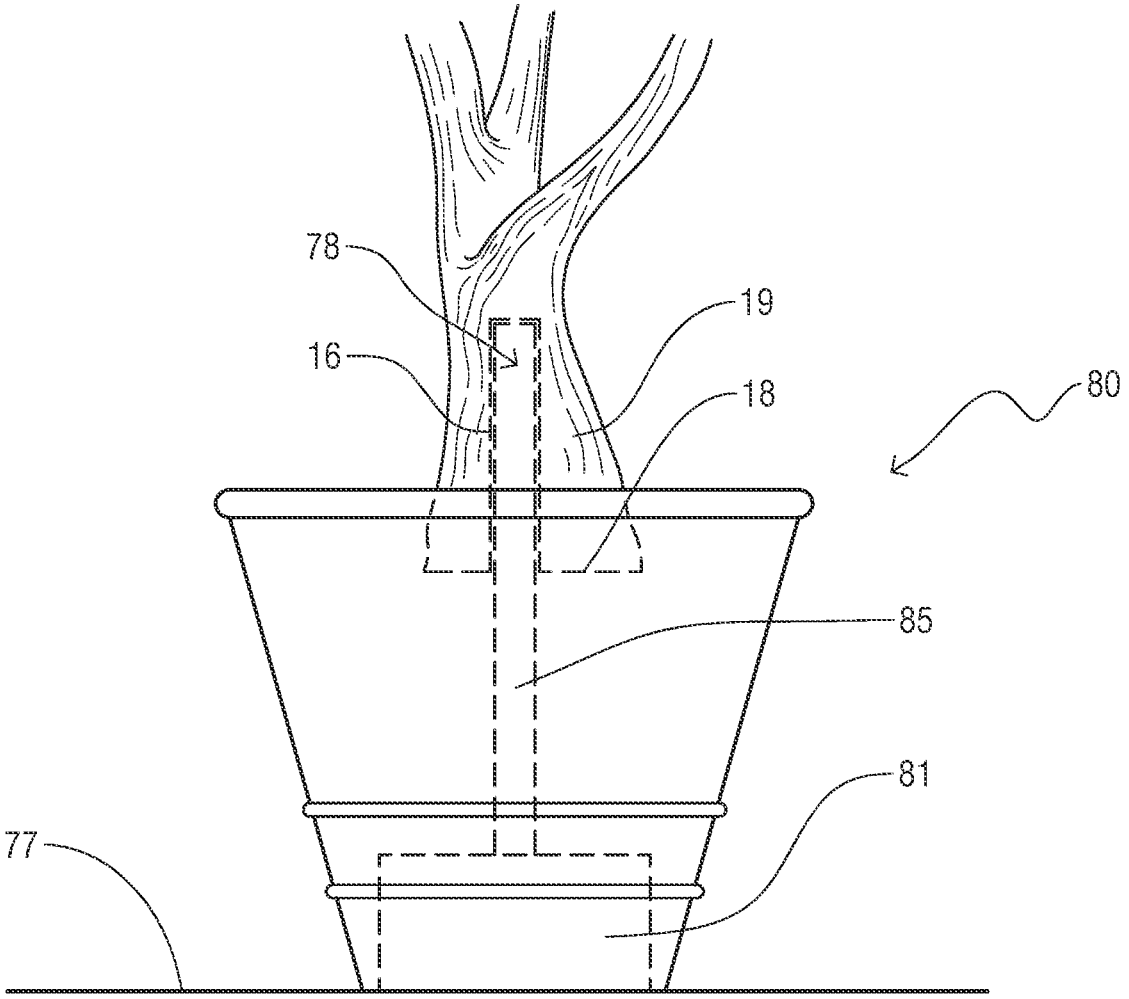
FIG. 9 is a cut diagram showing a second support base of an embodiment of the current invention.

The lower portion 19 (FIG. 1) of the trunk 15 may be appropriately anchored, based on considerations of the size and shape of the decorative tree system 10 and of the environment of use. FIG. 8 and FIG. 9 provide two exemplary support bases 70.

In an aspect shown in FIG. 8, the tree trunk lower portion 19 is configured with a receiving chamber 78 (defined by receiving chamber edges 16) and ends at a trunk lower boundary 18. The tree is to be placed on the finished floor 77. Below the finished floor 77 is a substrate 79, which may typically be concrete. A support base 70 comprises a horizontal portion, base plate 71, and a vertical portion, vertical extension 75. The vertical extension 75 is fixedly attached to, or formed integrally with, the base plate 71. The vertical extension 75 projects upwardly and is sized and shaped to be received by the receiving chamber 78. The vertical extension 75 may be formed of a metal cylinder, piping, or other elongated structure.

The horizontal base plate 71 extends outwardly beyond the vertical extension 75, and it is configured with multiple holes (defined by plate hole edges). The base plate 71 is first installed. A bolt 73 is positioned into each of the holes, inserted through flooring holes in the finished flooring 77, and firmly attached to the substrate 79. The tree then can be lowered onto the upright vertical extension 75, which is received within the receiving chamber. This serves to anchor the tree to the substrate 79 to prevent accidental toppling.

FIG. 8 shows the tree partially lowered onto the vertical extension 75 with the vertical extension 75 partially filling the receiving chamber 78 defined by receiving chamber edges 16. In an aspect, when fully lowered, the trunk lower boundary 18 is adjacent to the finished floor 77. In another aspect the trunk lower boundary 18 is slightly above the finished floor 77 with an interposed decorative element (not shown) filling the gap between the boundary 18 and the floor 77.

FIG. 9 shows another support base 70 aspect of the invention in which the tree is installed into and supported by a containing structure 80. The containing structure 80 may be a pot, basin, bowl, bucket, basket, urn, vessel, or other receptacle. The containing structure 80 is sized to receive and provide support to the tree and to visually coordinate with the look of the tree.

The support base of FIG. 9 includes both a horizontal portion, weighted foundational structure 81, and a vertical portion, vertical extension 85.

In one aspect the containing structure 80 may be bolted to a substrate 79, as shown in FIG. 8. In another aspect the containing structure 80 may include a weighted foundational structure 81 that is disposed in the bottom of the containing structure 80. The weighted foundational structure 81 may be formed of concrete or similar heavy material or may be formed by a frame filled with concrete or other heavy material.

A vertical extension 85 is fixedly attached to, or formed integrally with, the foundational structure 81. The foundational structure 81 is wider than the vertical extension 85. In similarity to the aspect shown in FIG. 8, the lower trunk 19 is configured with a receiving chamber 78 defined by edges 16.

In the aspect shown in FIG. 9, to install the tree into the support base 70, the support base 70 may be optionally bolted to the substrate 79. The vertical extension 85 is then inserted into the cavity of the receiving chamber 78. Optionally, the weight of the foundational structure 81 is used to balance and support the tree without the use of bolts to attach the support base 70 to the substrate 78. In this case, the foundational structure 81 is disposed in the bottom of the containing structure 80 with the vertical extension projecting upwardly. The tree is lowered onto the vertical extension 85 and the receiving chamber 78 accommodates the vertical extension 85.

In all the embodiments, the upper portion 11 of trunk 15 may generally be configured with multiple receiving stubs 20 (that may vary in angle and size) for receiving generally larger bottom branches 40 and generally smaller upper branches 40. However, the upper portion 11 may only have a single receiving stub 20 for receiving a single treetop-type branch 40. Generally, the angle of the stub 20 determines the angle of the installed branch 40.

The design of the external decorative skin 13, 23, 43 may vary, with the chosen design based on aesthetic desires or functional requirements. Often the external decorative skin 13, 23, 43 may be designed to imitate a type of natural bark. However, other textures, grains, veneers, and other natural or artificial designs may also be used; for instance, designs incorporating the style of simulated alligator skin, brick, hair, pebbles, paisleys, plush fabrics, smooth or textured metallic finishes or the like could be utilized.

The materials and production processes of the components of the decorative tree with insertable branches system 10 may vary based on considerations of size, environment of use, aesthetic desires, and functional requirements. However, in an exemplary production process, the internal supports 17, 27, 47 may be formed of metal (such as steel) piping of appropriate sizes. The metal pipe of the trunk internal support 17 may be welded to the smaller metal pipe of the stub internal support 27 at trunk-stub connection 12 (FIG. 3). The alignment protuberance 45 may be welded onto the metal pipe forming internal support 47. The metal pipe of the stub internal support 27 may have the channel 25 cut into it. The external decorative skin 13, 23, 43 may be preferably formed of urethane, which may be adhered with a methacrylate adhesive onto the internal supports 17, 27, 47, or may be adhered to an intermediary layer of urethane soft foam that is applied to wire mesh that is supported by metal pipes. As shown in FIGS. 4-5, the decorative skin is preferably applied without a seam between the stub 20 and the tree trunk 15, so the stub 20 appears to be a part of the tree trunk 15. Until the methacrylate adhesive cures, a plastic film may be used to wrap the glued portions to allow proper curing.

Optionally, the internal supports 17, 27, 47 may be formed of a wire mesh with stronger metal reinforcements. Then the external decorative skin 13, 23, 43 may be attached to the wire mesh. The stronger metal reinforcements can be used, for example, to fixedly attach the stub internal support 27 to the trunk internal support 17.

Optionally, the internal supports 17, 27, 47 may be formed of a heavy wire frame with tubular portions forming the distal end of the stub internal support 27 and the male sleeve insert 50. Or a combination of materials may be used to form the various parts of the internal supports 17, 27, 47. For example, the trunk internal support 17 may be formed of heavy wire with a tubular member welded to it to serve as the receptor 29 of the stub 20.

The branch-leaf component 65 may be attached to the branch 40 in any of a variety of ways, but it is preferably fixedly attached. The branch-leaf component 65 may have a metal end that can be welded to a metal pipe of the branch internal support 47. Or the lower proximal end of branch internal support 47 may be formed of a metal pipe with the upper distal end formed of a wire mesh to which the branch-leaf component 65 is firmly attached, such as by wire or adhesive.

The tree trunk 15, stub 20, and the branches 40 are fabricated, meaning that they are assembled from parts or sections and made or constructed by art or skill and human or robotic labor. The materials used include metal, various plastics, fabrics, other manmade materials, and also preserved natural materials (such as preserved natural branches, trunks, or leaves). In general, the framing of the trunk may be done with wire with a fabric attached to the wire to form the outer portion. For outdoor locations or larger trees, a heavier gauge wire and heavier outer fabric may be used than for indoor or smaller trees. The materials may be used with or without coatings or sealants. Coatings may be used to add advantages such as ease of cleaning and fire retardation. For instance, the leaves may be made of polyester fabric, but have a polyurethane coating to repel dust, prevent penetration of the fabric by spills, and enhance cleaning. The fabricated parts may duplicate, copy, or replicate something from nature, or they may create an interesting presentation or display that is quite different than that found in nature (for instance, metal triangle-shaped attachments substituted for leaves attached to LED light strands substituted for branch skin). In some cases, manmade branches and/or branch-leaf components are used with a manmade fabric-covered wire trunk. Preserved natural branches can be adapted to attach to the male sleeve insert 50 so can be used with a manmade metal pipe trunk or with a preserved trunk 15 fitted with a stub 20 to receive the male sleeve insert 50. Preserved or manmade branch-leaf components can be used with either type of branch.

The size of the stub 20 and the branches 40 are determined or influenced by the size of the tree trunk 15. For instance, the entire tree may have a height of 10 feet with an 8-foot diameter canopy, in which case the trunk may have a diameter of from 3 to 5 inches and the tree may weigh less than 200 pounds. In another instance, the tree might be an 18-foot tree with a 20-foot diameter canopy with a trunk from 15 to 21 inches in diameter with the tree weighing more than 600 pounds. And, though in general, the tree may be over 6 feet tall, smaller trees are within the scope of the invention. For instance, a table-top size tree having a height of only 2 to 4 feet and a trunk diameter of three-fourths inch to 3 inches may utilize the provided stub 20 and the branches 40.

Variations of the structures presented are within the scope of the invention. For instance, in any of the embodiments the channel 25 may be cut through the stub external decorative skin or may be an interior channel only cut through the internal support 27. Additionally, the aspects of one embodiment may be utilized with another embodiment. For instance, the magnets of the third embodiment can be utilized with the first or second embodiments.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A decorative tree system, comprising:

a tree trunk (15);

a receiving limb stub (20) fixedly attached to said tree trunk (15); said receiving limb stub (20) comprising:

(a.) a stub internal support (27);

(b.) a stub external decorative skin (23); and (c.) channel edges (22) defining a channel (25); wherein said channel (25) is disposed below said stub external decorative skin (23); and a branch (40) comprising:

(a.) a branch proximal edge (49) disposed at a proximal end of said branch (40);

(b.) a branch external decorative skin (43);

(c.) a branch skin edge (69) forming a proximal end of said branch external decorative skin (43);

(d.) an unskinned proximal male insert sleeve (50) extending between said branch proximal edge (49) to said branch skin edge (69); wherein said unskinned proximal male insert sleeve (50) is sized and shaped to be received within said stub internal support (27); and (e.) an alignment protuberance (45) extending outwardly from said unskinned proximal male insert sleeve (50); wherein said alignment protuberance (45) is sized and shaped to be received by said channel (25).

2. The decorative tree system as recited in claim 1, wherein said branch (40) further comprises a branch-leaf component (65) fixedly attached to a distal portion of said branch (40).

3. The decorative tree system as recited in claim 1, further comprising at least one permanent magnet disposed at a branch internal support proximal portion (48) or at a distal end (38) of said receiving limb stub (20).

4. The decorative tree system as recited in claim 1, further comprising a support base (70) comprising a foundational portion (71, 81) extending substantially horizontally and a vertical portion (75, 85) extending substantially vertically from said foundational portion (71, 81); wherein said tree trunk (15) comprises a receiving chamber (78) defined by receiving chamber edges (16) that is configured to receive said vertical portion (75, 85).

5. The decorative tree system as recited in claim 4, wherein said foundational portion (71, 81) is configured for attaching to a floor substrate.

6. The decorative tree system as recited in claim 4, wherein said foundational portion (71, 81) is weighted.

7. The decorative tree system as recited in claim 4, further comprising a containing structure (80) that accommodates insertion of at least a portion of said support base (70).

8. A method of using a decorative tree system, comprising:

selecting a tree trunk (15) supporting multiple limb stubs (20); wherein each of said multiple limb stubs (20) comprise a stub internal support (27), a stub external decorative skin (23) covering said stub internal support (27), and channel edges (22) defining a channel (25) disposed below said stub external decorative skin (23);

obtaining a first set (60) of interchangeable branches; wherein each branch (40) of said first set (60) of interchangeable branches comprises a distal portion at least partially covered by a first-set branch external decorative skin (43) and comprises a proximal first-set unskinned male insert sleeve (50); wherein said first-set unskinned male insert sleeve carries an alignment protuberance (45);

selecting an initial first-set branch (40) from said first set (60) of interchangeable branches;

aligning said alignment protuberance (45) of said initial first-set branch (40) with said channel (25) of a first one of said multiple limb stubs (20);

sliding said alignment protuberance (45) of said initial first-set branch (40) into said channel (25) of said first one of said multiple limb stubs (20);

selecting a secondary first-set branch (40) from said first set (60) of interchangeable branches;

aligning said alignment protuberance (45) of said secondary first-set branch (40) with said channel (25) of a second one of said multiple limb stubs (20);

sliding said alignment protuberance (45) of said secondary first-set branch (40) into said channel (25) of said second one of said multiple limb stubs (20);

removing said alignment protuberance (45) of said initial first-set branch (40) out of said channel (25)) of said first one of said multiple limb stubs (20) to remove said initial first-set branch (40); and removing said alignment protuberance (45) of said secondary first-set branch (40) out of said channel (25)) of said second one of said multiple limb stubs (20) to remove said secondary first-set branch (40).

9. The method of using a decorative tree system as recited in claim 8 further comprising:

obtaining a second set (60) of interchangeable branches; wherein each branch (40) of said second set (60) of interchangeable branches comprises a distal portion at least partially covered by a second-set branch external decorative skin (43) and comprises a proximal second-set unskinned male insert sleeve (50); wherein said second-set unskinned male insert sleeve (50) carries an alignment protuberance (45);

selecting an initial second-set branch (40) from said second set (60) of interchangeable branches;

aligning said alignment protuberance (45) of said initial second-set branch (40) with said channel (25) of said first one of said multiple limb stubs (20);

sliding said alignment protuberance (45) of said initial second-set branch (40) into said channel (25) of said first one of said multiple limb stubs (20);

selecting a secondary second-set branch (40) from said second set (60) of interchangeable branches;

aligning said alignment protuberance (45) of said secondary second-set branch (40) with said channel (25) of said second one of said multiple limb stubs (20);

sliding said alignment protuberance (45) of said secondary second-set branch (40) into said channel (25) of said second one of said multiple limb stubs (20);

removing said alignment protuberance (45) of said initial second-set branch (40) out of said channel (25)) of said first one of said multiple limb stubs (20) to remove said initial second-set branch (40); and removing said alignment protuberance (45) of said secondary second-set branch (40) out of said channel (25)) of said second one of said multiple limb stubs (20) to remove said secondary second-set branch (40).

10. The method of using a decorative tree system of claim 8, further comprising:

engaging a magnetic connection between said one of said multiple limb stubs (20) and said initial first-set branch (40) from said first set (60) of interchangeable branches.

11. The method of using a decorative tree system of claim 8, wherein at least one of said multiple limb stubs (20) or said initial first-set branch (40) comprises a permanent magnet.

12. The method of using a decorative tree system of claim 8, further comprising:

lifting said tree trunk (15) onto a support base (70).

13. The method of using a decorative tree system of claim 12, further comprising:

inserting a vertical portion (75, 85) of said support base (70) into a receiving chamber (78) defined by receiving chamber edges (16) and disposed within said tree trunk (15).

14. The method of using a decorative tree system of claim 12, further comprising:

attaching a horizontal portion (71, 81) of said support base (70) to a floor substrate.

15. The method of using a decorative tree system of claim 12, further comprising:

setting said support base (70) into a base-containing structure (80).

* * * * *